US005464045A

United States Patent [19]

Niemann et al.

[11] Patent Number: 5,464,045

[45] Date of Patent: Nov. 7, 1995

[54] SPOUT MOUNTING SYSTEM

[75] Inventors: James E. Niemann, Noblesville; Anthony G. Spangler, Greensburg, both of Ind.

[73] Assignee: Masco Corporation of Indiana, Indianapolis, Ind.

[21] Appl. No.: 333,446

[22] Filed: Nov. 2, 1994

Related U.S. Application Data

[63] Continuation-in-part of Ser. No. 182,888, Jan. 18, 1994, Pat. No. 5,381,830.

[51] Int. Cl.[6] ..... F16K 21/00

[52] U.S. Cl. ..... 137/801; 137/615; 251/284

[58] Field of Search ..... 137/801, 615; 285/280, 282; 251/284

[56] References Cited

U.S. PATENT DOCUMENTS

| | | | |
|---|---|---|---|
| 2,570,635 | 10/1951 | Beyer, Jr. | 137/801 |
| 4,037,624 | 7/1977 | Turner et al. | 137/615 |
| 4,064,900 | 12/1977 | Schmitt | 137/315 |
| 4,346,735 | 8/1982 | Raz | 137/801 |
| 4,456,287 | 6/1984 | Bisonaya | 137/801 |
| 4,592,388 | 6/1986 | Wilcox | 137/801 |
| 4,695,078 | 9/1987 | Anderson . | |
| 4,763,693 | 8/1988 | Valley . | |
| 4,976,287 | 12/1990 | Sheen | 137/801 |
| 5,110,157 | 5/1992 | Chen . | |
| 5,381,830 | 1/1995 | Niemann et al. | 137/801 |

FOREIGN PATENT DOCUMENTS

| | | |
|---|---|---|
| 4296274 | 10/1992 | Japan . |
| 931705 | 7/1963 | United Kingdom . |

*Primary Examiner*—A. Michael Chambers

*Attorney, Agent, or Firm*—Myron B. Kapustij; Malcolm L. Sutherland

[57] ABSTRACT

A spout mounting assembly which includes a centerbody having an annular groove, a spout having two slots extending through its wall fitted rotatably over said centerbody with said slots aligned with said annular groove, a retaining ring having radially inwardly extending lugs which extend through the slots and are positioned within the annular groove thereby preventing axial movement of the spout relative to the centerbody, and a bonnet slidably disposed over the retaining ring to keep the ring in position.

9 Claims, 5 Drawing Sheets

SPOUT MOUNTING SYSTEM

RELATED APPLICATIONS

This application is a Continuation-In-Part application of application Ser. No. 08/182,888 filed on Jan. 18, 1994 now U.S. Pat. No. 5,381,830 issued Jan. 17, 1995.

FIELD OF THE INVENTION

This invention relates to a spout assembly for mounting spouts on wash basins, sinks and the like.

SUMMARY OF THE INVENTION

According to the invention there is provided a spout assembly for mounting a spout on a deck of a wash basin, sink and the like. The spout assembly comprises a spout having two slots extending through the wall of the spout adjacent the bottom of the spout, a centerbody having an annular groove, a split retainer ring comprised of a resilient plastic material having two radially inwardly extending lugs, and a bonnet slidably mounted on the spout.

In mounting the spout the spout is slipped over the centerbody so that the slots in the spout are aligned with the annular groove in the centerbody. The retainer ring is maneuvered on the spout until the lugs snap into the slots and into the annular groove in the centerbody. The bonnet is then slid over the ring in order to keep the ring in place. By virtue of the lugs extending through the slots in the spout into the annular groove in the centerbody the spout is locked against axial movement relative to the centerbody but is free to rotate on the centerbody.

DESCRIPTION OF THE PREFERRED EMBODIMENT

Figure 1:
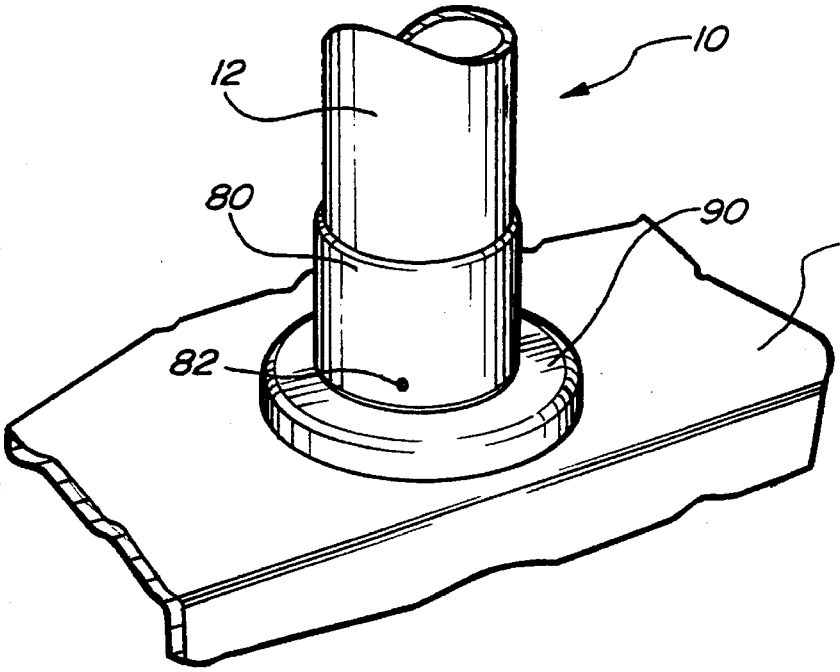
FIG. 1 is a perspective view of the spout assembly mounted to a sink.
Figure 2:
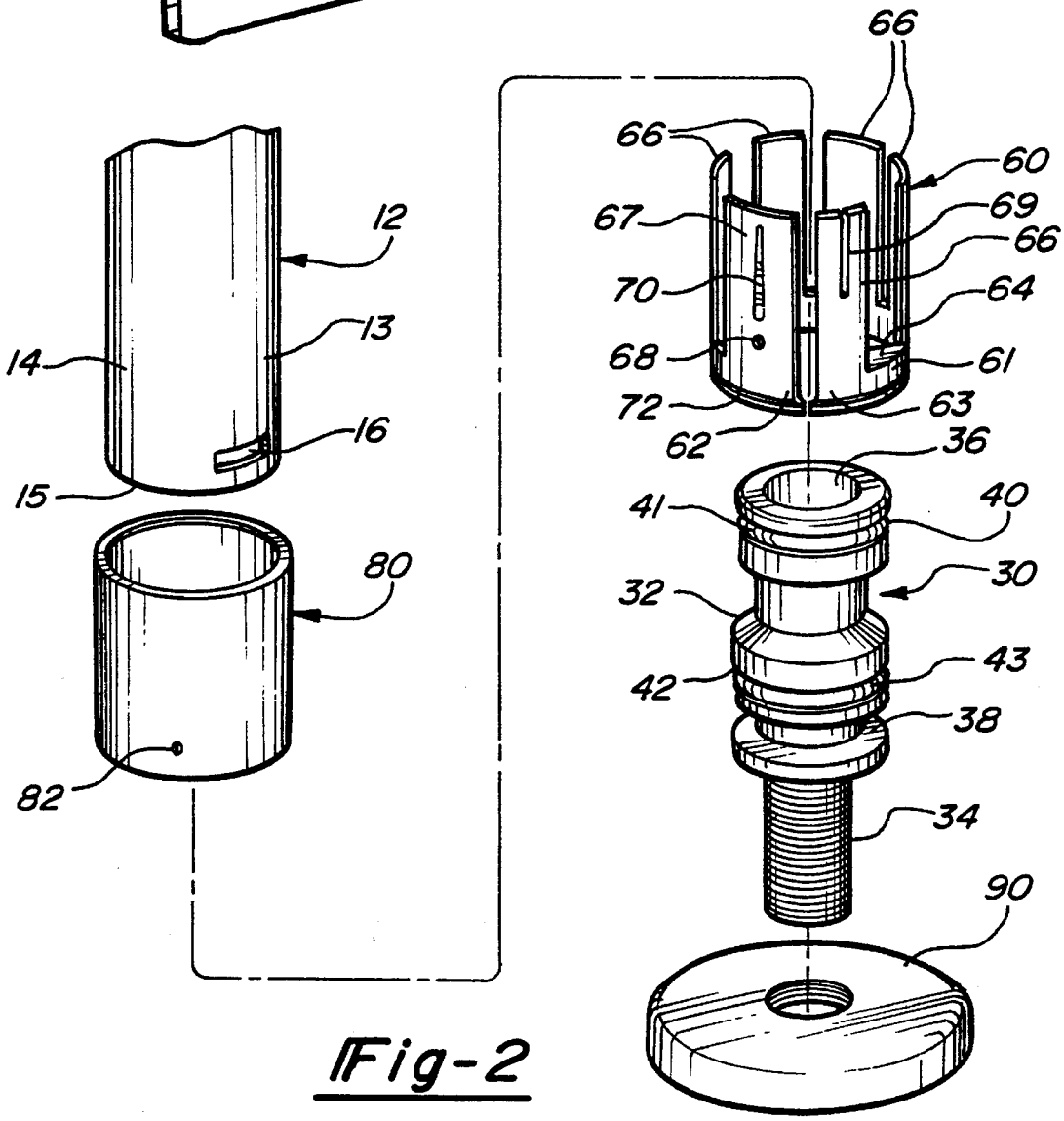
FIG. 2 is an exploded perspective view showing the component parts of the spout assembly system.
Figure 3:
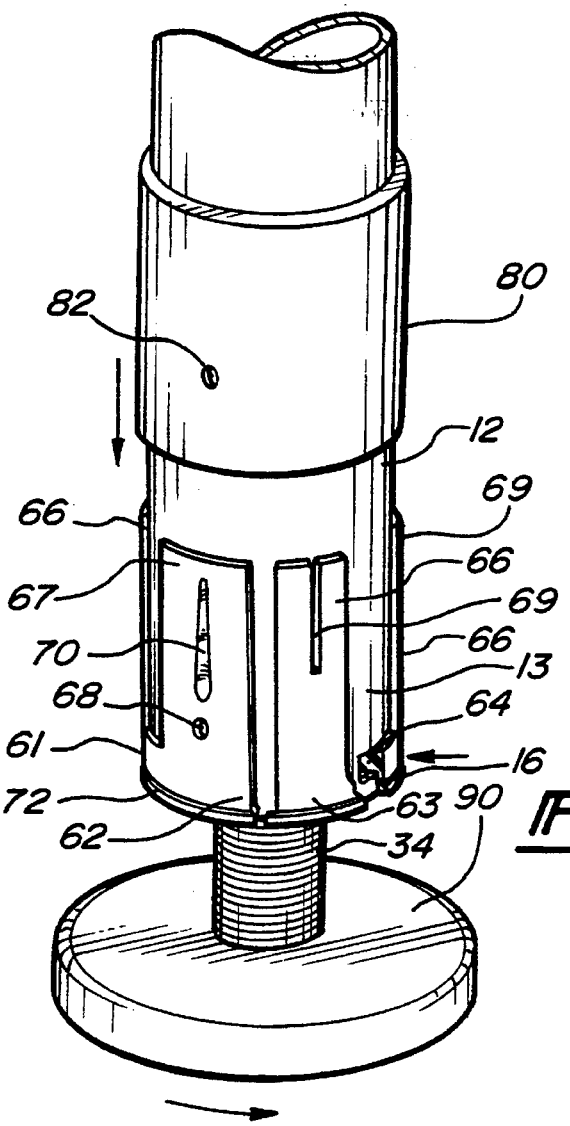
FIG. 3 is a perspective partially sectioned view showing the spout disposed over the centerbody, the retaining ring engaged with the spout, and the bonnet ready to be slipped over the retaining ring.

The spout mounting assembly 10 of the instant invention is comprised of a spout 12, a resilient retainer ring 60, a centerbody 30, and a bonnet 80.

The spout 12 includes a bottom section 14 having two slots 16, 18 extending through the side wall 13 thereof. In the embodiment shown in the Figures there are two slots 16, 18 circumferentially spaced apart from each other 180°. It is to be understood that the bottom section 14 may have less than two slots, i.e., one slot, or more than two slots, e.g., three or four. It is also to be understood that the two slots 16 and 18 need not be circumferentially spaced apart by 180°. The bottom section 14 of spout 12 fits over the top section 32 of faucet centerbody 30 as illustrated in FIGS. 4 and 5.

Figure 4:
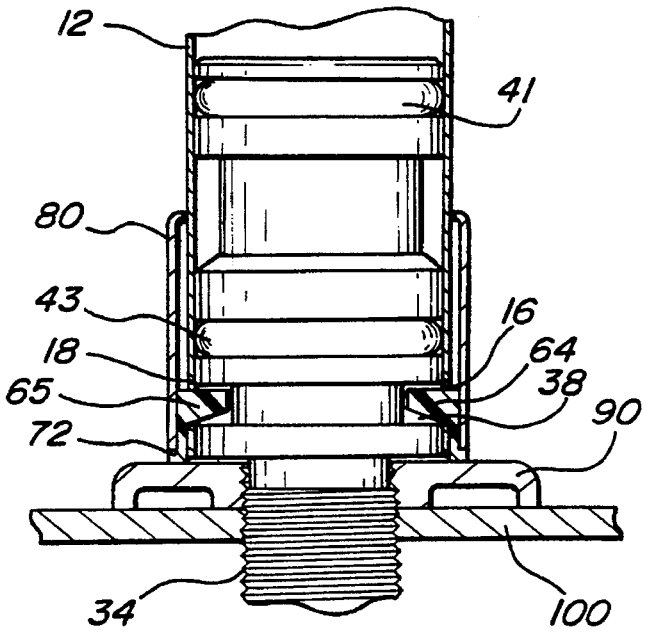
FIG. 4 is a vertical sectional view of the spout assembly in its assembled form showing the lugs of the retainer ring extending through the slots in the spout into the retaining groove in the centerbody.
Figure 5:
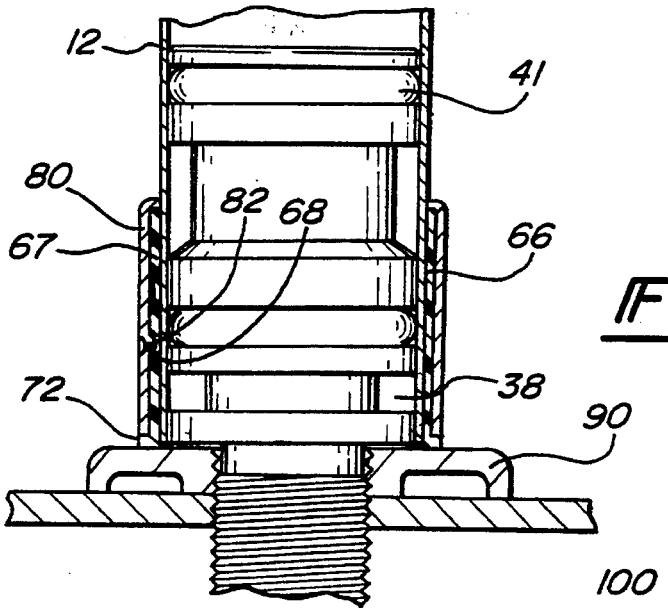
FIG. 5 is a vertical sectional view of the spout assembly in its assembled state showing the radially inwardly projecting protrusion of the bonnet engaged with the hole in the retainer ring.

In the embodiment illustrated in FIGS. 2–6 centerbody 30 includes a top section 32 and a bottom section 34, and has a water passageway 36 extending therethrough. Cold and hot water inlet pipes, not shown, are in communication with the bottom section of the centerbody 30. Top section 32 is slidably received within the bottom section 14 of spout 12. Top section 32 has an annular groove 38 near the bottom thereof. As illustrated in FIG. 4 groove 38 receives the lugs 64, 65 of retainer ring 60. The top section 32 also has annular groove 40 in which is disposed seal ring 41 and annular groove 42 in which is disposed seal ring 43. Annular grooves 40 and 41 are located above annular groove 38. The seal rings 41 and 43 form a water-tight seal with the inner wall of the bottom section 14 of spout 12. As illustrated in FIG. 4 when the faucet centerbody 30 is received inside the lower section 14 of spout 12 the seal rings 41 and 43 are above slots 16 and 18.

The split retaining ring 60 is made of a resilient plastic material and includes a generally annular main body section 61. The body section 61 is not completely annular but is split forming two legs 62, 63. This split allows the split retaining ring 60 to open and close with the legs 62, 63 splitting apart or coming together in a radial direction. Two radially inwardly projecting lugs 64, 65 are disposed in the interior wall of annular body section 61. In the embodiment illustrated in the figures, the lugs 64, 65 are circumferentially spaced apart 180°. As illustrated in FIG. 4, in the assembled state, lugs 64 and 65 project through slots 16, 18 and into groove 38. Lugs 64 and 65 are thus sized to extend through slots 16, 18 and fit into groove 38.

Extending upwardly from annular section 61 are a plurality of circumferentially spaced apart fingers 66 and 67. Some of the fingers 66 include axially extending crush ribs 69. A hole or dimple 68 is disposed in a finger 67. The hole or dimple 68 is adapted to receive radially inwardly extending protrusion 82 in the inner wall of bonnet 80. A tear shaped guide groove 70 is disposed above dimple 68 in finger 67. The guide groove 70 aids in guiding protrusion 82 into engagement with hole or dimple 68.

Split retaining ring 60 in its normal non-expanded state is sized, i.e., has an inner diameter, to fit over the bottom section 14 of spout 12. When the lugs 64, 65 are inserted through slots 16, 18 in spout 12 and into annular retaining groove 38 the two legs 62 and 63 spring back toward each other.

To utilize the instant mounting system to mount spout 12 on the centerbody 30 retainer ring 60 is disposed over the bottom section 14 of spout 12 with the lugs in contact with the outer surface of the spout. This is accomplished by spreading apart legs 62 and 63 of the retainer ring 60 and slipping said ring over the bottom section 14 of spout 12. The lugs 64, 65 contacting the side wall of spout 12 keep the legs 62, 63 spaced apart. The retainer ring 60 is slipped onto said spout 12 with the fingers 66, 67 toward the top. The lower section 14 of the spout is then slipped over the centerbody 30 until the slots 16, 18 are aligned with annular retaining groove 38. The retainer ring 60 is then moved over the surface of spout 12 in order to snap the lugs 64, 65 into slots 16, 18. When the lugs 64, 65 are snapped into slots 16, 18 they extend into the retaining groove 38 thereby securing the spout against axial or vertical movement on the centerbody but allowing rotational movement of the spout on the centerbody.

Once the lugs 64, 65 are in place and extend through slots 16, 18 into annular retaining groove 38 the bonnet 80 is slipped over the retainer ring 60 to secure retainer ring 60 in its locking position. The bonnet 80 is partially secured in place over retainer ring 60 by means of inner protrusion 82 of bonnet 80 engaging dimple or hole 68 in annular ring 60. A tear shaped guide groove 70 is provided in finger 67. The guide groove 70 serves to aid in guiding the protrusion 82 of bonnet 80 into dimple or hole 68 in annular ring 60. The fingers 66, 67 aid in centering the bonnet over the spout and protecting the finish of the spout by keeping the inner surface of the bonnet from coming into contact with the outer surface of the spout. The bonnet is slid down over the fingers 66, 67 and is frictionally engaged with the crush ribs 69 forming an interference fit therewith.

The retainer ring 60 further has a radially extending annular shoulder 72 at the bottom thereof. As best illustrated in FIGS. 4 and 5 in the assembled state the shoulder 72 of ring 60 extends below the bottom rim 15 of the bottom section of spout 14. The shoulder 72 functions in effect as a washer keeping the bonnet 80 and bottom rim 15 of spout 12 from contacting and scratching the collar or escutcheon 12.

Figure 6:
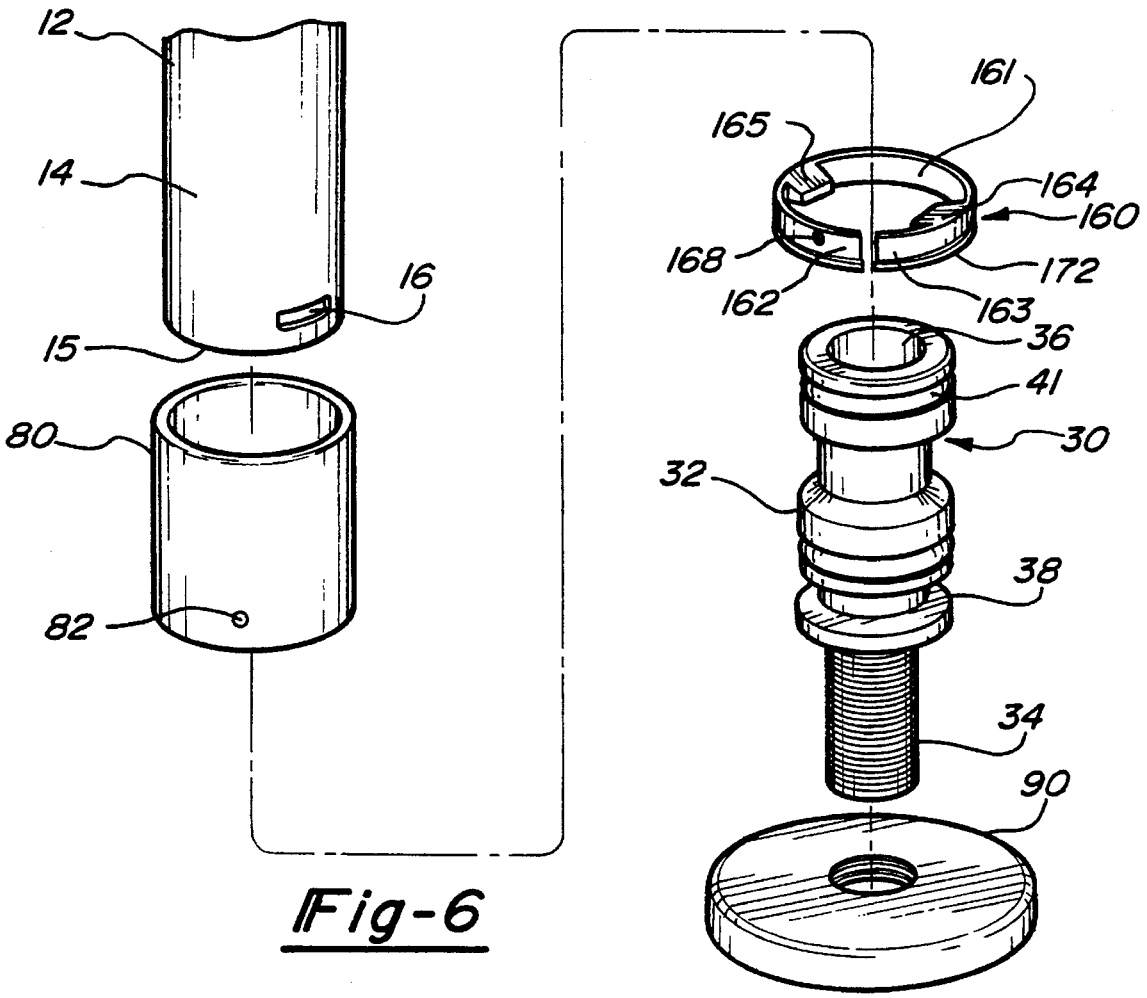
FIG. 6 is an exploded perspective view showing a modified retainer ring.
Figure 7:
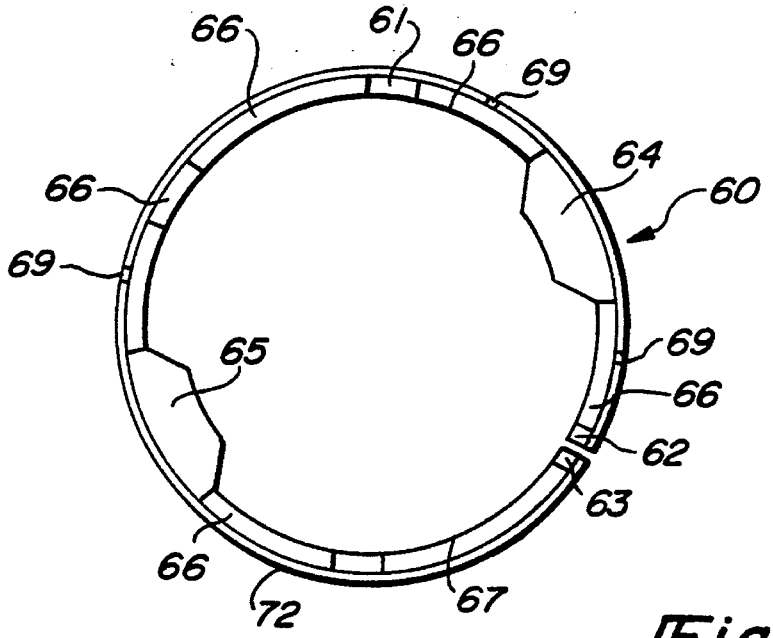
FIG. 7 is a top plan view of the retainer ring of FIG. 1.

FIG. 6 illustrates another embodiment of the split retainer ring. In this embodiment retainer ring 160 is comprised only of annular body section 161. It does not contain fingers 66 and 67. As illustrated in FIG. 6 the dimple or hole 168 is located in the annular section 161 instead of in finger 67. The ring 160 contains radial inwardly projecting lugs 164, 165 and a radially extending annular shoulder 172.

The split retainer ring is made from a resilient plastic material which allows the legs 62 and 63 to be spread apart and to resiliently snap back together. For example Celcon™ by Celanese is a suitable material.

Figure 8:
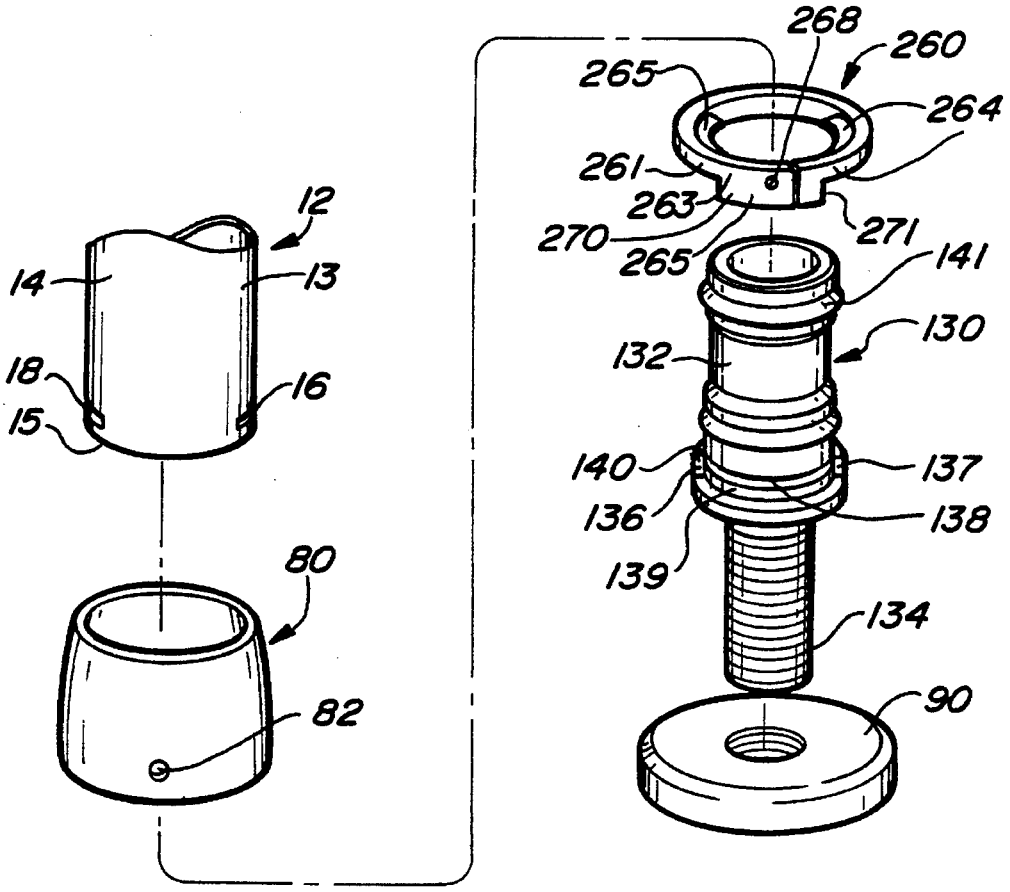
FIG. 8 is an exploded perspective view showing the component parts of another embodiment of the spout assembly.
Figure 9:
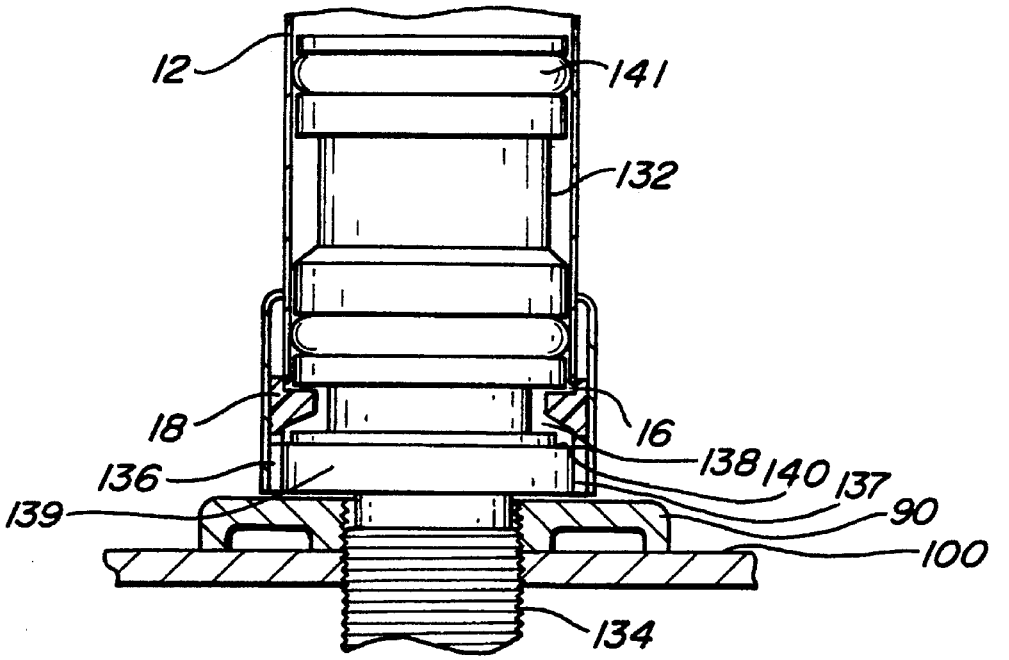
FIG. 9 is a vertical sectional view of the spout assembly of FIG. 8 in its assembled form showing the lugs of the retainer ring of the embodiment of FIG. 8 extending through the slots in the spout into the retaining groove in the centerbody.
Figure 10:
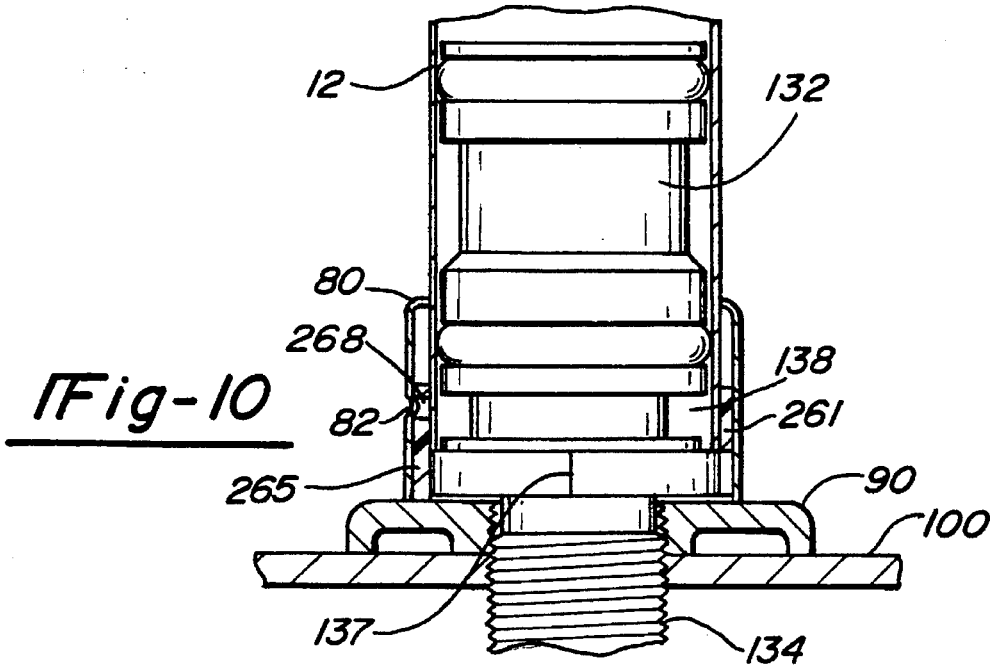
FIG. 10 is a vertical sectional view of the spout assembly of FIG. 8 in its assembled form showing the radially inwardly projecting protrusion of the bonnet engaged with the hole in the retainer ring of the embodiment of FIG. 8.

In the embodiment illustrated in FIGS. 8–10 the retainer ring 260 not only locks the spout 12 against axial movement but also controls or limits rotation of the spout. In this embodiment the retainer ring 260 is comprised of an annular body section 261. The ring is split into two sections 263, 264. Extending radially inwardly from the interior wall of the body section 261 are lugs 264, 265. Lugs 264, 265 are adapted to extend through slots 16, 18 in the lower section 14 of spout 12 and engage annular retaining groove 138 in centerbody 130 thereby securing the spout 12 against axial or vertical movement relative to the centerbody 130 but allowing rotational movement of the spout on the centerbody.

The retaining ring 260 has a downwardly extending flange 265. In the embodiment shown in FIGS. 8–10 the retaining ring 260 is split through the flange 265. It is to be understood, however, that the retaining ring can be split at locations other than flange 265.

Located below retaining groove 138 is groove 139. Groove 139 does not extend all the way around centerbody 130 but is delimited by circumferentially spaced apart stops 136, 137. Stops 136 and 137 have a top surface 140 upon which the bottom 15 of spout 12 rests. The stops 136 and 137 extend radially outwardly of bottom section 14 of the spout so that they can be engaged by the sides 270, 271 of flange 265 of retaining ring 260. The flange 265 is disposed intermediate stop members 136, 137. Upon clockwise rotation of spout 12, and therefore retaining ring 260, around centerbody 260 side 270 of flange 265 will eventually abut stop 136, thereby preventing further clockwise rotation of spout 12. Upon counterclockwise rotation of spout 12, and therefore retaining 260, around centerbody 260 side 271 of flange 265 abuts stop 137, thereby preventing further counterclockwise rotation of retaining ring 260.

An opening or dimple 268 is provided in flange 265 and is adapted to receive radially inwardly extending protrusion 82 in the inner wall of bonnet 80.

In this embodiment rotation of the spout can be controlled, e.g., rotation can be limited to areas over the sink. The degree of rotation can be varied by varying the longitudinal size of the flange 265. Making the flange 265 wider reduces the degree of rotation while providing a narrower flange increases the degree of rotation.

What we claim is:

1. Spout assembly for mounting a spout comprising:

centerbody having an annular retainer groove therein;

spout having at least one slot extending through the side wall thereof adjacent the bottom edge thereof, said spout being rotatably mounted over said centerbody with said slot aligned with said groove;

retaining member comprised of a split annular body portion having at least one radially inwardly extending lug mounted over said spout, said lug extending through said slot and into said annular groove to prevent axial movement of said spout relative to said centerbody but allow rotational movement of said spout on said centerbody;

bonnet slidably mounted on said spout disposed over said retaining member to secure said retaining member in place; and first means on said centerbody cooperable with second means on said retaining member for limiting rotational movement of said spout on said centerbody.

2. The assembly of claim 1 wherein said second means comprises a flange extending downwardly from said annular body portion and said first means comprises at least one stop member adapted to abut against a side edge of said flange upon rotation of said retaining member on said centerbody.

3. The assembly of claim 2 wherein said spout has two circumferentially spaced apart slots.

4. The assembly of claim 3 wherein said annular body portion has two radially inwardly extending lugs.

5. The assembly of claim 4 wherein said retaining member is comprised of resilient plastic.

6. The assembly of claim 5 wherein said annular body portion has a depression or aperture on its outer surface which is engaged by a corresponding radially inwardly extending projection on the interior wall of said bonnet to secure said bonnet to said retaining member against rotational and axial movement of said bonnet relative to said retaining member.

7. The assembly of claim 6 wherein said depression or aperture is in said flange.

8. The assembly of claim 2 wherein said first means comprises two circumferentially spaced apart stop members.

9. The assembly of claim 8 wherein said flange is disposed intermediate said two stop members.

* * * * *